United States Patent [19]

Clark

[11] 4,059,165

[45] Nov. 22, 1977

[54] VERSATILE FLUID MOTOR AND PUMP

[76] Inventor: Wallace Clark, 1830 S. German Church Road, Indianapolis, Ind. 46239

[21] Appl. No.: 705,043

[22] Filed: July 14, 1976

Related U.S. Application Data

[63] Continuation-in-part of Ser. No. 638,639, Dec. 8, 1975, Pat. No. 4,051,910.

[51] Int. Cl.[2] ..... E21B 3/12

[52] U.S. Cl. ..... 175/107; 418/48

[58] Field of Search ..... 175/107, 343, 106; 418/48; 308/141-146, 59

[56] References Cited

U.S. PATENT DOCUMENTS

| | | | |
|---|---|---|---|
| 1,015,434 | 1/1912 | Gray | 308/146 X |
| 3,097,167 | 7/1963 | Beyerle | 308/143 X |
| 3,203,350 | 8/1965 | Chang | 418/48 |
| 3,429,390 | 2/1969 | Bennett | 175/343 |
| 3,603,407 | 9/1971 | Clark | 175/107 |
| 3,802,803 | 4/1974 | Bogdanov | 418/48 X |
| 3,912,426 | 10/1975 | Tschirky | 418/48 |

FOREIGN PATENT DOCUMENTS

| | | | |
|---|---|---|---|
| 1,385,404 | 12/1964 | France | 175/343 |
| 1,235,834 | 3/1967 | Germany | 175/107 |
| 2,441,837 | 3/1975 | Germany | 175/107 |

*Primary Examiner*—Ernest R. Purser
*Assistant Examiner*—William F. Pate, III
*Attorney, Agent, or Firm*—Melville, Strasser, Foster & Hoffman

[57] ABSTRACT

There is disclosed a fluid motor composed of a helical gear pair wherein an inner member has one or more external helical threads and a cooperating outer member has one or more internal helical threads, the number of helical threads on the inner and outer members differing by one. The outer member is secured to one of the sections of a water swivel which is conventional except that it has an axial intake, radial tube and inner member supporting guide, and means are associated with an end of the inner member and with the outer section of the water swivel to prevent relative rotation between said inner and outer members while permitting gyration with oscillation of the inner member in relation to the outer member. Each end of the device has a tapered thread. The motor may be used either end up. A drill pipe or suitable sub is threaded into one end of the device and a tool is threaded into the other end of the device, directly or with a sub between. In one embodiment the outer member of the gear pair is held stationary by the drill pipe which is threaded into it or with a sub between, and the tool which is threaded into the other end is rotated by the rotation of the inner member and the rotating part of the water swivel. In another embodiment, the drill pipe is threaded into the stationary part of the water swivel or with a sub between and thus the inner element of the gear pair is held stationary and the outer element is caused to rotate with the rotating portion of the water swivel, and thus the tool is driven by the outer element of the gear pair. The tool is useful in earth boring as in well drilling, coring, mining, foundation settings, and substrata exploration. Two or more devices according to the invention may be coupled together with various advantages.

37 Claims, 16 Drawing Figures

VERSATILE FLUID MOTOR AND PUMP

CROSS REFERENCE TO RELATED APPLICATION

This application is a continuation-in-part of a copending application, Ser. No. 638,639, filed Dec. 8, 1975, in the name of Wallace Clark and now Pat. No. 4,051,910.

BRIEF SUMMARY OF THE INVENTION

U.S. Pat. No. 3,932,072 issued Jan. 13, 1976 discloses a helical gear pair wherein the inner member has a radial arm non-rotatably secured at one of its ends, and fixed means are provided to limit the other end of the radial arm to reciprocatory and oscillatory motion, so that the outer member is free to rotate on its true axis while the inner member gyrates with respect to the outer member. The disclosure in said application relates to a pump.

U.S. Pat. No. 3,951,097 issued Apr. 20, 1976 discloses a hydraulic motor or a pump, again utilizing a helical gear pair as above described and utilizing the radial member to permit gyration with oscillation while restraining contrary rotation between the inner and outer members, and said application discloses the use of water swivels, often referred to as drilling swivels when used for drilling. Either the inner or outer member, according to said last named application, may be caused to rotate, depending upon whether the radial element is secured to the rotating or to the stationary part of the water swivel. The device of said last named application may be used as a pump or as a motor and is disclosed in connection with marine propulsion. The water swivels used in that application are conventional in all principal respects, except for the radial tubes and inner member supporting guides.

According to the present invention, a water swivel is modified so as to have an axial inlet rather than a right angled inlet as is conventional in water swivels. Again the fluid motor of the present application comprises a helical gear pair wherein the inner member has one or more external helical threads and the cooperating outer member has one or more internal helical threads, the number of helical threads on the inner and outer members differing by one. The basic helical gear pair elements are manufactured and sold by Robbins & Myers, Inc. under the trademark MOYNO.

The water swivel has two elements capable of relative rotation. In other words, one element of the water swivel may be held stationary while the other rotates, and vice versa. According to the present invention, the inner member is provided with means to restrain contrary rotation between the inner and outer members while permitting gyration with oscillation of the inner member, as described in said U.S. Pat. No. 3,932,072; and in one embodiment the ball cooperates with the rotation preventing element within a tube which is secured to such element of the water swivel, or it may, in another embodiment, cooperate within a tube in the rotating element of the water swivel, while the other, or fixed element of the water swivel and the other motor element may be prevented from rotation by the drill string. The outer member of the helical gear pair, which is generally of rubber or similar material, is secured to the other member of the water swivel.

Each end of the device is provided with a tapered internal thread so that either a sub or a section of drill pipe with sub may be threaded into it or a tool, such as a drill bit or a coring tool, for example, may be threaded into it, directly or with a sub.

According to the present invention, the drill pipe can in all cases be held stationary. Thus, if the drill pipe is threaded into the end constituted by the water swivel and the tool is threaded into the other end, the inner element will be held stationary and the outer element, to which the tool is secured, will rotate.

If, on the other hand, the tool is threaded into the end constituted by the water swivel and the drill pipe or sub is threaded into the other end, then the outer element of the gear pair will be held stationary while the inner element gyrates with oscillation and rotates and since it is connected by the ball and tube to the rotatable element of the water swivel, the tool will be rotated by the inner element of the pair.

Thus, there is provided a two way tool which may be used "either end up" with attendant advantages in each case, as will be pointed out in more detail hereinafter. The two different positions, however, require a change in hand of the motor element threads in order to maintain right hand threading in the entire drill string below the hanging water swivel in the drilling rig, from which the fluid comes, since the hanging water swivel conventionally is provided with a left hand thread.

The device of the present invention can be used by hanging it to the hook in the derrick of a conventional drilling rig and it could perform the function of what is commonly known as a "power swivel", with a torque arm, preferably telescoping, sliding up and down on a taut wire line. This will eliminate the use of a kelly and a rotary table during drilling, except for the advisability of a pipe guide bushing in the table. It can be used with the rotating part of the table free to turn so that the kelly passing through the kelly bushing is rotated, and the table must be free to turn.

With means to prevent rotation in the hole, as disclosed in FIG. 10 of U.S. Pat. No. 3,603,407 in the name of Wallace Clark, the tool of the present invention may be suspended from a wire line connected to a powered reel and fluid may be supplied by means of a hose paid out from a hose reel, lengths at a time, thus substituting in a similar manner for pipe lengths. The tool may thus be used for light clean-out work and again it may be used "either end up". Similarly, the device may be used with the wire line reel and hose reel and rotation preventing device for drilling, coring, etc., as will be described in more detail hereinafter.

A number of motors as disclosed herein, or as disclosed in U.S. Pat. No. 3,603,407 or No. 2,898,087, may be coupled together in tandem. Thus, the drill pipe may be threaded into that end of a motor constituted by the water swivel and a second motor may then be threaded into the other end. The second motor may be threaded in "either end up" with different results.

Similarly, if the drill pipe is threaded into the other end, and a second motor is threaded into that end constituted by the water swivel, the second motor may be added "either end up" and again with various effects which will be described in more detail hereinafter.

DETAILED DESCRIPTION

The early patents to R. J. L. Moineau, Nos. 1,892,217, 2,483,370 and others, disclose pumps made up of helical gear pairs. These early patents also disclose that the devices could be used as motors. In the operation of the helical gear pair, one of the pair is stationary and the other element rotates and gyrates. Thus, in order to transmit concentric rotation to a shaft or in order that the device may be driven by an electric motor, for example, which runs on true axes, a connecting rod and universal joints had to be provided.

According to said U.S. Pat. No. 3,932,072, a radial arm having a ball on its end was secured to the inner member and the ball was capable of reciprocation in a tube attached to the stationary device. Thus, connecting rods and universal joints were eliminated and yet gyration with oscillation was permitted, but relative member rotation was prevented. Reference may be had to said U.S. Pat. No. 3,932,072 for a detailed description of the relative rotation preventing means.

In said U.S. Pat. No. 3,951,097, it was disclosed how water swivels could be employed in connection with a hydraulic motor or pump. The water swivels there disclosed were conventional with radial water inlets. These water swivels comprise two relatively rotatable elements with suitable seals.

According to the present invention, a water swivel is modified to provide an axial inlet rather than a radial inlet and the inlet is provided with a tapered internal thread. The thread is such as to accommodate, for example, the threaded end of a section of drill pipe, directly or with a suitable sub, or a tool having a tapered male thread, directly or with a suitable sub.

Figure 1:
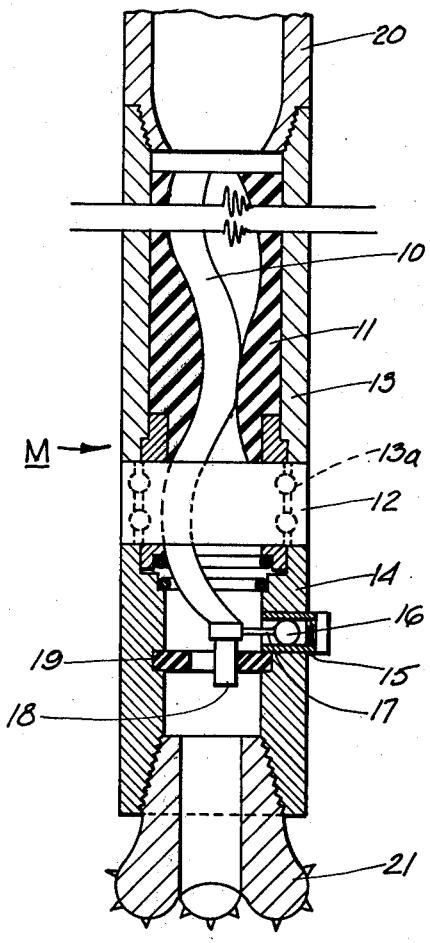
FIG. 1 is a cross sectional view of a tool according to the present invention in one mode of use.

Referring now in more detail to the drawings, and particularly FIG. 1, the gear pair comprises the inner member 10 and the outer member 11, with left hand threads. A water swivel is indicated generally at 12.

Figure 14:
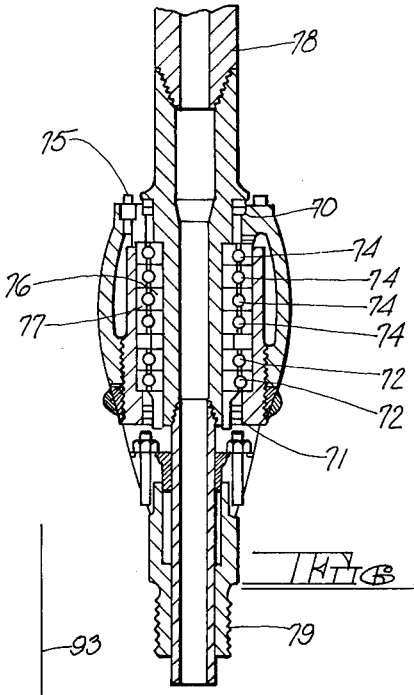
FIG. 14 is a detailed cross sectional view of the typical bearings used in a water swivel.

A typical water swivel bearing is shown in some detail in FIG. 14 and it will be understood that the water swivel shown in the remainder of the views are somewhat diagrammatic in the interest of clarity. The only real difference between the swivels used in the various Figures in the present application and the conventional drilling swivels is that conventional drilling swivels generally have lifting means for the upper connection rather than threads, and a gooseneck for a water connection, whereas in the present instance a straight through water passage is provided, and tubes or axial slots are provided therein. However the thrust bearing capacities are installed oppositely in accordance with the opposite direction of the predominant thrust when used at the bottom of the drill string. The ball bearings in the water swivel are sealed at the top by the seal 70 and at the bottom by the seal 71. This is to keep the drilling mud away from the bearings. The bearings indicated at 72 are up thrust bearings and the bearings indicated at 74 are down thrust bearings. Provision for oiling the bearings is made at 75. It will be understood that the portion of the water swivel carrying the races 76 will be relatively stationary while the portion carrying the races 77 will rotate. Thus, an element connected into the upper end of the illustrated water swivel bearing as at 78 would be relatively stationary while an element connected onto the lower end as at 79 would rotate.

In said FIG. 1 the outer member 11 is fixed in the casing 13 and the lower end of the member 13 indicated in broken lines at 13*a* constitutes the fixed section of the water swivel 12. The rotating section of the water swivel is indicated at 14 and it is provided with the tube 15 in which the ball 16 may reciprocate. The ball 16 is secured on the end of an arm 17 fixed to the inner element 10. An extension 18 is provided on the end of the inner member 10 which operates within a supporting guide 19 which is of rubber or suitable resilient material. The function of the supporting guide is clearly described in said U.S. Pat. No. 3,951,097, referred to therein as a damping ring.

In FIG. 1 a sub or a section of drill pipe is indicated at 20 and is threaded into the member 13. A tool 21 is threaded into the rotating portion of the water swivel 14.

If now the drill stem 20 is held stationary (as by being secured to a polygonal kelly passing through a nonrotatable kelly bushing) and a fluid such as, for example, drilling mud is pumped down through the drill stem 20 and through the fluid motor, the inner member 10 is caused to rotate and it carries with it the tool 21.

Figure 2:
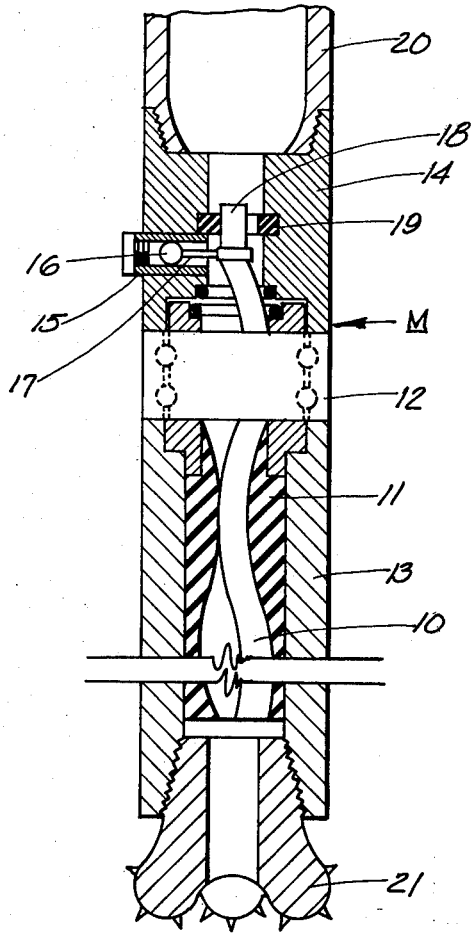
FIG. 2 is a view similar to FIG. 1 in an inverted mode of use.

In FIG. 2, the fluid motor of FIG. 1 is turned upside down, but with opposite threading of the elements to right hand, instead of the left hand threading of the elements in FIG. 1, and the drill stem or sub 20 is threaded into the section 14 while the tool 21 is threaded into the member 13. In this situation, when drilling mud is pumped down through the member 20, the member 14 is held against rotation and it therefore holds the inner member 10 against rotation while permitting it to gyrate with oscillation and then the outer member 11 carrying with it the casing 13 and the tool 21 threaded thereinto rotates.

While it has been indicated above that the drill stem is held stationary, it is of course possible to permit it to rotate slowly in either direction which will assist in keeping the bore wall from becoming clogged or the mud on the walls channeled. Thus, slow rotation may be accomplished with the tool in the FIG. 1 configuration or in the FIG. 2 configuration. In this connection, reference may be had to U.S. Pat. No. 3,675,727 in the name of Wallace Clark. That patent describes how this slow rotation may be used to maintain optimum drilling rates and for protection from overstress on the motor.

The motor of the present invention may be used for the drilling of shallow wells, the drilling of deep wells for water, oil or gas, for sampling of earth to determine geological or minerallogical data in connection therewith. While drilling practices are well understood, it may be desirable to very briefly outline conventional practice. As a matter of general practice, some sort of drill bit is secured to the lower end of a piece of drill pipe. A suitable rig is provided on the ground to hold the drill pipe in a vertical position and cause it to rotate. A drilling mud is pumped through the drill pipe and issued through the drill bit, washing away the particles of earth or rock produced by the drilling operation and flushing them to the surface through the annular space between the drill hole and the drill pipe.

As the hole becomes too deep for the particular piece of drill pipe being used, another section of drill pipe is coupled to the first and the operation proceeds as before. As the hole attains a great depth, the rotative effort to the drill bit is transmitted by a very long pipe composed of a number of sections coupled together. If it should be necessary to replace the drill bit, the entire assembly of drill pipe must be pulled up out of the hole and uncoupled, section by section, and when a new drill bit has been attached, the entire process is reversed until the drill bit again reaches the bottom of the hole. This is a very tedious and time consuming operation. Specific attachment designs for motors comprising a helical gear pair, used as a down-hole motor, were taught in Clark Pat. No. 2,893,693, dated July 7, 1959.

Figure 3:
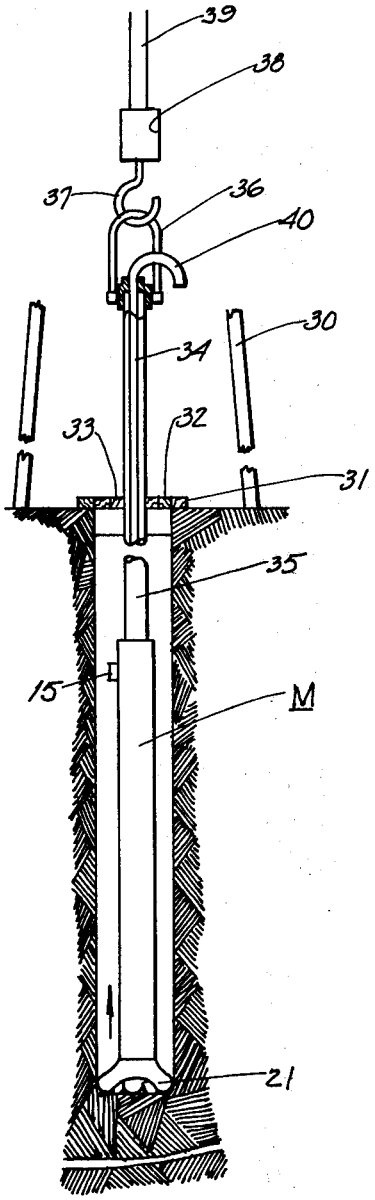
FIG. 3 is a somewhat diagrammatic representation of the use of the tool of the present invention in drilling with the use of a kelly and a stationary kelly bushing.

The tool disclosed in FIGS. 1 and 2 is very versatile and may be used in a number of different ways. In FIG. 3, the motor is shown in use in drilling a hole for a well or the like. A conventional derrick is diagrammatically shown at 30. On the floor of the rig is provided the so-called rotary table comprising a stationary portion 31, a rotating portion 32, and a kelly bushing 33. A polygonal kelly 34 is shown passing through the kelly bushing. A string of drill pipe 34 is attached to the end of the kelly and the fluid motor according to either FIG. 1 or FIG. 2 is attached to the end of the string 35. The tool 21 is threaded into the lower end of the motor M.

The kelly is provided with suspension means 36 and the suspension means is suspended from a hook 37 attached to the traveling block 38 connected by the cables 39 to the conventional hoisting mechanism (not shown). A fluid supply connection 40 is provided through which drilling mud may be pumped through the kelly and the drill pipe to the motor M.

Figure 4:
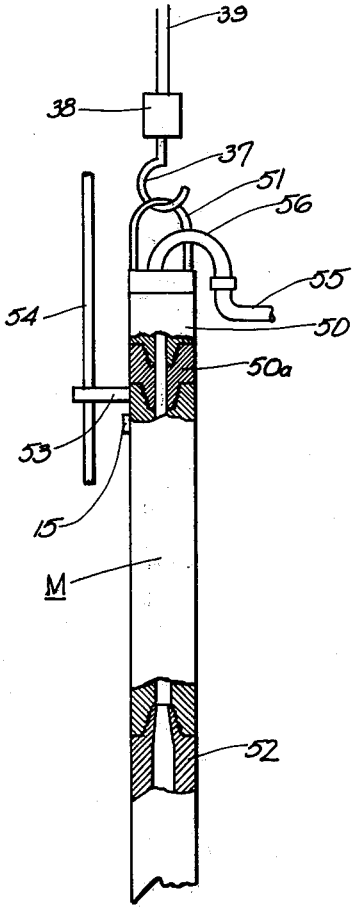
FIG. 4 is a more or less diagrammatic view of the use of a tool according to the present invention with a torque arm and a taut wire line, in the nature of a power swivel.

FIG. 4 shows the fluid motor of either FIG. 1 or FIG. 2 (preferably FIG. 2) hanging from the hook of the derrick of a conventional drilling rig and performing the function of a "power swivel". A conventional water swivel is provided at 50 which is hung from the hook 37 by means of the bail 51 and the hook 37 is attached to the traveling block 38 and cable 39 as in FIG. 3. The motor is threaded into the lower end of the water swivel 50 with a sub **50*a* having a left hand box up and a right pin down, as shown in FIG. 4, to accommodate conventional water swivel left hand threads, and the drill stem 52 is threaded into the lower end of the motor. In this case, the embodiment of FIG. 2 is shown and a torque arm 53 is secured to what in FIG. 2 is designated as the portion 14 of the water swivel 12. The torque arm 53 engages a taut line 54 along which it can slide so that the stationary part of the motor M is prevented from rotation but can move up and down along the cable 54**. The use of a power swivel in drilling can eliminate the use of a kelly and rotary table during drilling.

It is, of course, also possible to furnish the device of FIG. 2 purely as a power swivel, by substituting for the part 14 of the water swivel of FIG. 2 a conventional part having a standard gooseneck intake instead of the axial intake shown. Such substitute part would be provided with the torque arm 53 and suspension means 51. Thus the regular water swivel 50 hanging on the derrick would be eliminated.

The embodiment of FIG. 4 has the advantage of eliminating the need for a separate power supply as is usually necessary with a power swivel. The drilling mud is supplied through the hose 55 and gooseneck 56 and thus the usual supplementary pump and hydraulic lines are eliminated and the power supply comes from the regular mud pump which must be in use at all times when drilling.

Figure 5:
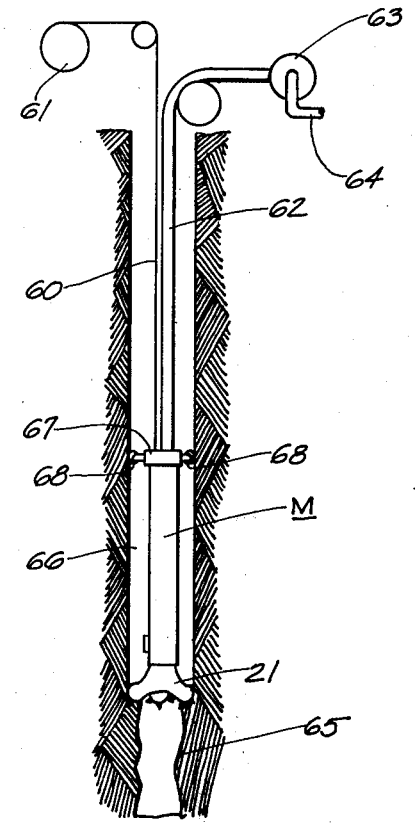
FIG. 5 is a diagrammatic view of the use of the tool together with rotation preventing means with the tool suspended from a wire line used in light clean-out operations.
Figure 6:
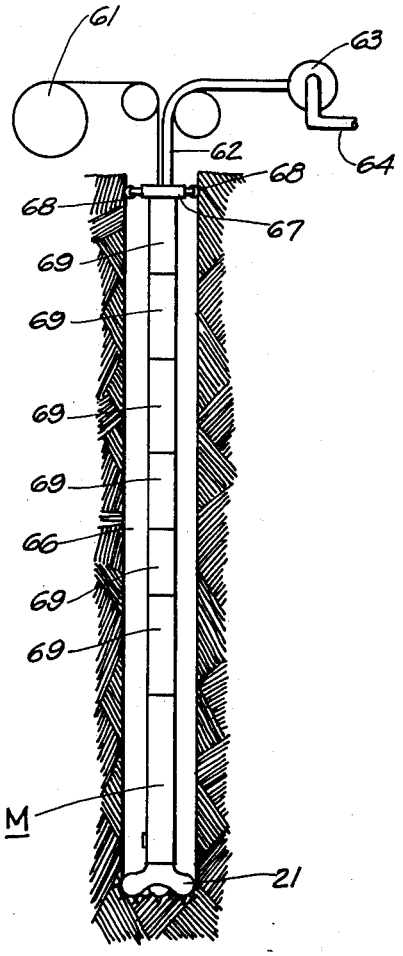
FIG. 6 is a view similar to FIG. 5 showing the tool used for boring.

In FIGS. 5 and 6, there is illustrated how the fluid motor of the present invention can be used for clean-out operations or for drilling without the use of drill pipe. In FIG. 5 the motor M, which may be either in the configuration of FIG. 1 or that of FIG. 2, is suspended by a wire line 60 controlled by a powered wire line reel 61. The hose 62 supplies drilling mud by means of a hose reel 63 and a hose providing a fluid intake at 64. In FIG. 5, the bore below the tool 21 indicated at 65 is rough, whereas above the tool 21 at 66 it is smooth. In this particular embodiment, the tool is being used for light clean-out work.

In order to prevent the element of the tool which is to be the fixed one (depending upon which way up the tool is employed) use is made of a device indicated generally at 67 which is described in detail in U.S. Pat. No. 3,603,407 and is illustrated particularly in FIG. 10. Actually it comprises a pair of opposed cylinders with pistons therein which are subject to the pressure of the drilling mud supplied through the hose 62. This pressure forces the pistons outwardly and on the ends of the pistons rollers are provided as indicated at 68. These rollers permit the tool to ride up and down in the bore 66 but prevent the tool from rotating in the bore.

In FIG. 6 somewhat the same arrangement is shown for drilling purposes. In this embodiment, a plurality of drill collars 69 are used as required to provide appropriate weight on the bit 21. Again rotation is prevented by the device 67 described in connection with FIG. 5.

From the foregoing it will be seen that the fluid motor of FIGS. 1 and 2 is a very versatile device in that it can be used either end up, and it can be used for coring, milling or drilling, for light clean-out work, for drilling, milling or coring without drill pipe, and for use with a kelly which is fixed against rotation and in various other ways which will suggest themselves to those skilled in the art.

Depending upon which way up the motor is used, the outer member may be caused to rotate and drive the tool or the inner member may be caused to rotate and drive the tool. In directional drilling wherein the bore is changed in direction at some point, the operator would probably prefer that the outer element be non-rotating. On the other hand, in coring and diamond drilling where a smooth performance free from vibration is desired, the flywheel effect of the heavy outer member rotating would be very desirable. This would also be true where the rock being drilled is a broken conglomerate or fractured strata which imparts variable shock to the system and causes excess strain on the motor and other parts of the drill stem, and here the flywheel effect would be particularly advantageous. If additional flywheel effect is desired, it can be provided by adding drill collars below the motor, with the boring or cutting tool attached thereon.

On the other hand, in smooth drilling there is no need to swing the excessive extra weight of the outer member and it would be desirable to change to the unit with the outer member stationary.

Figure 8:
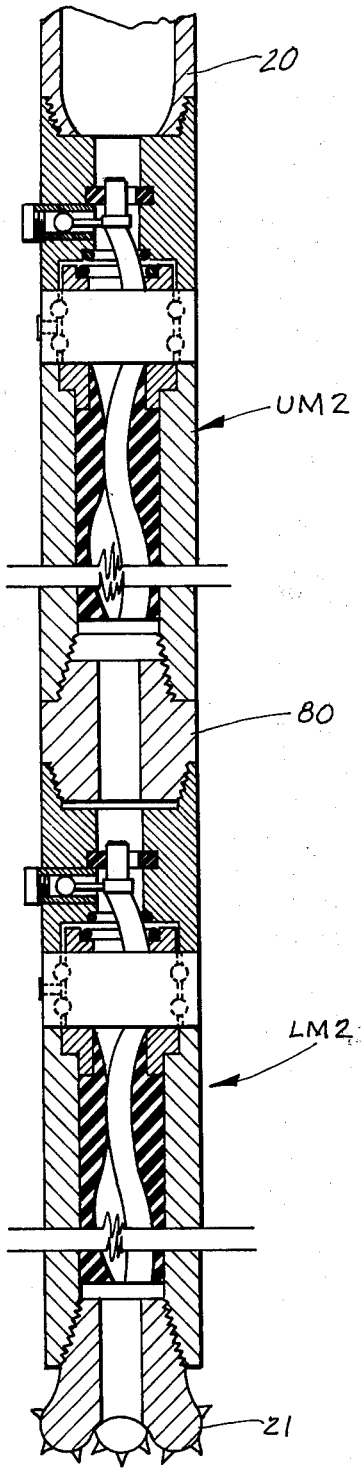
FIG. 8 is a view similar to FIG. 7 but showing two motors according to FIG. 2 coupled together.
Figure 9:
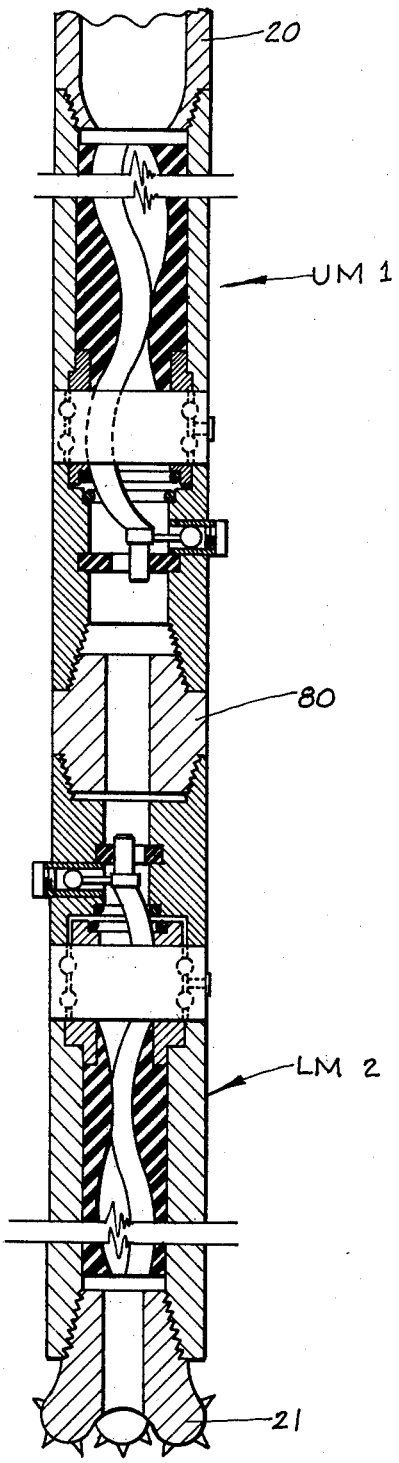
FIG. 9 is a view similar to FIGS. 7 and 8 showing a motor according to FIG. 1 having a motor according to FIG. 2 coupled underneath it.

The device of the present invention also has advantages in improving the sub-sea wire line coring and drilling possibilities if used as depicted in FIGS. 8 and 9 of said U.S. Pat. No. 3,603,407, by eliminating inherent vibration, and by the elimination of bearings which were not grease packed, as is the case with the water swivel bearings in the motor of the present invention.

Figure 7:
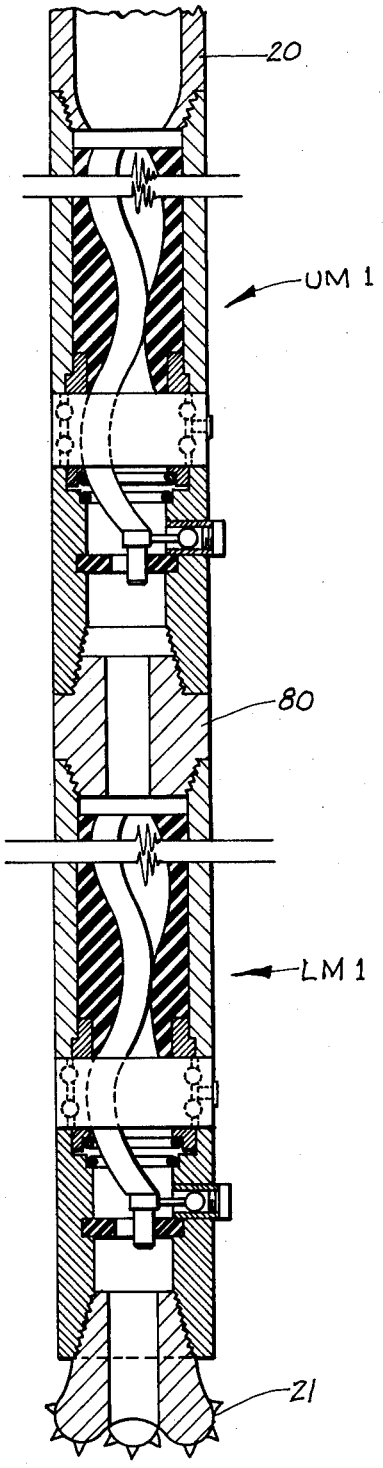
FIG. 7 is a somewhat diagrammatic view with parts in cross section showing the motor according to FIG. 1 coupled to another motor according to FIG. 1.

Referring more specifically to FIG. 7 there is shown an arrangement wherein a FIG. 1 type motor is coupled to another FIG. 1 type motor. In FIGS. 7 to 10 inclusive, the upper motor will be designated as UM and if it is of the FIG. 1 type, it will be designated UM1. If it is of the FIG. 2 type, it will be designated UM2. Similarly, the lower motor will be designated LM1 or LM2, as may be appropriate. In FIG. 7 there is the upper motor UM1 and the lower motor LM1, both according to FIG. 1. The drill stem is again indicated at 20 and the bit at 21. Since the motors of FIGS. 1 and 2 have a box at each end, the motors are connected by means of a pin-to-pin sub 80. It will be understood that one of the motors may be provided with a pin end rather than a box end and then there may be a pin-to-box connection without the use of a sub to connect the two motors. It will also be understood that the drill stem is threaded into the upper end of the motor UM1 with right-hand threads and that both the pins of the pin-to-pin sub 80 will be provided with right-hand threads. The box at the lower end of the motor LM1 and the bit will be provided with right-hand threads. It should also be noted that the motors UM1 and LM1 are provided with the inner and outer Moineau elements having left-hand threads. In FIG. 7, if the drill stem is held stationary, then the outer element of UM1 is held stationary and the inner element turns right-handed (as viewed from above). Since the inner element of UM1 is connected to the outer element of LM1, the outer element of LM1 will turn right-handed and the inner element of LM1 will also turn right-handed, but at twice the speed.

As an example of what may be accomplished by the arrangement of FIG. 7, let it be assumed that both the motors UM1 and LM1 are designed to operate at 350 rpm. In such case the speed of the bit will be 700 rpm. and the torque will be the same, and the horsepower is multiplied by 2.

There may not be an advantage in stacking units higher than two because the speed is progressively additive even though the horsepower is multiplied. Thus, for example, a third unit could be placed below FIG. 7 and if it is designed to rotate at 350 rpm. in the original direction, the speed of the bit will be 1050 rpm. in the right-hand direction and it will have the same torque and three times the horsepower of the one unit, with no more pressure drop per unit than the rating of a single unit.

In FIG. 8 there is shown an arrangement with both upper motor UM2 and lower motor LM2 being of the type shown in FIG. 2. Here again the threads between the drill stem and the upper motor and between the upper motor and the sub 80 and between the sub 80 and the lower motor, and between the motor LM2 and the bit 21 are all right-hand threads. The motors UM2 and LM2 will have the Moineau elements with right-hand threads. If the drill stem 20 is held stationary, the inside element of UM2 will remain stationary but with a left-hand strain. The outer element of UM2 will rotate right-hand. The outer element of UM2 is connected by the sub 80 to the inner element of LM2 which therefore turns right-hand, while the outer element of LM2 turns right-hand at twice the speed. The bit again turns right-hand.

In FIG. 9 there is shown an upper motor UM1 having at lower motor LM2 connected to it. Again, the threads between the drill stem and UM1 and between UM1 and the sub 80 and between the sub 80 and LM2 and between LM2 and the bit 21 are right-hand threads. The Moineau elements of UM1 will have left-hand threads, and the Moineau elements of LM2 will have right-hand threads. With the drill stem 20 held stationary, the outer element of UM1 is held stationary but straining to turn left-handed. The inside element of UM1 turns right-handed and since it is connected to the inner element of LM2, the latter will turn right-handed while the outer element of LM2 turns right-handed at twice the speed.

Figure 10:
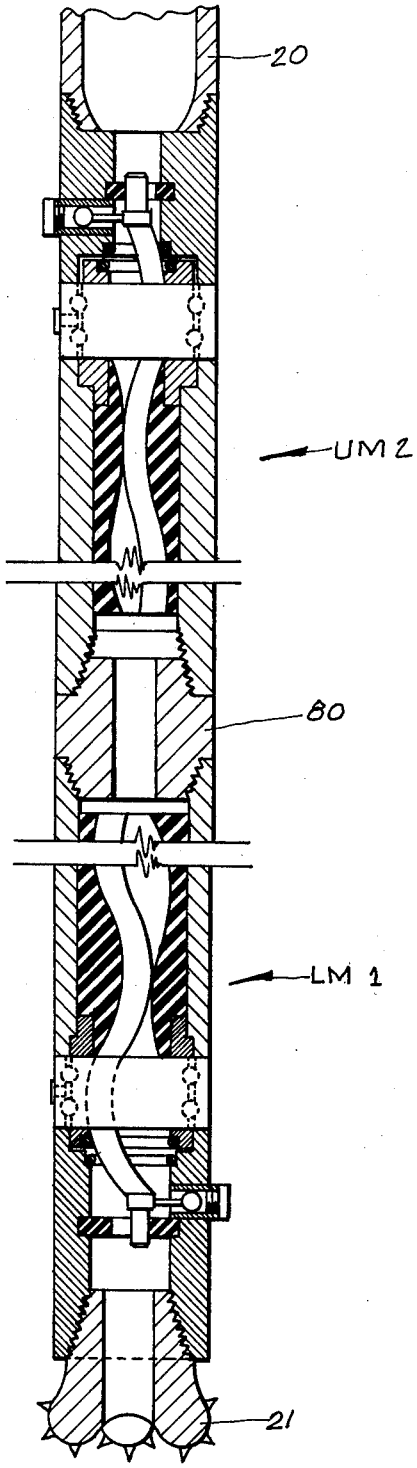
FIG. 10 is a view similar to FIG. 9 showing a motor according to FIG. 2 having a motor according to FIG. 1 coupled underneath it.

In FIG. 10 there is shown the reverse of FIG. 9, i.e. a motor UM2 is placed above a motor LM1. The inner element of UM2 is connected to the drill stem 20 which is held stationary and therefore the inner element of UM2 is held stationary but with a left-hand strain. The outer element of UM2 turns right-handed. The outer element of UM2 being connected to the outer element of LM1, the latter will turn right-handed while the inner element of LM1 turns right-handed at twice the speed. UM2 has right-hand threads while LM1 has Moineau elements with left-hand threads and again all the threads between the various sections are right-hand.

It should be observed that whenever the upper motor is of FIG. 2 type, the additional flywheel effect is produced with its housing rotating. As suggested above, in stacking motors according to FIGS. 7 to 10 inclusive, instead of the pin-to-pin connectors disclosed and with the purpose of saving in over-all length, the upper motor may be provided with a pin on its lower end which could be directly connected to the box on the upper end of the lower motor. There would thus be a pin-to-box connection directly, without the use of a sub. Conversely, the upper motor can have a box on its lower end and the lower motor could have a pin on its upper end for the same purpose. The use of the subs assist in standardizing the units but may not be desirable in some cases.

It should be noted that if a stack of two motors of equal power is used, the power of the string is doubled, but regardless of the combinations of motors of FIGS. 1 and 2 the speed is also doubled. Under certain drilling conditions (as for example in diamond drilling or coring), situations may indicate high speed with less weight on the bit.

If the hand of the elements in FIG. 1 is left-hand and the hand of the elements in FIG. 2 is right-hand, then no matter how the motors are stacked, the power and speed are doubled. In this situation, the bit threading on the bit pin in all cases is right-hand and is attached to a right-hand thread at the bottom of the bottom motor, either directly or through a sub. All subs and connections will be right-hand threaded to each other and to the drill stem and thus tight threading is maintained to the earth's surface. If the connection of swivels to the outer member is with threads (it is not so indicated in the drawings) such threads would be left-hand and this is conventional for maintenance of thread tightness for water swivels.

It may be observed that in a stack of motors as above described, the output will be equally balanced in work load, hydraulically, by the unique arrangement which incorporates partly a mechanical linkage between motors and partly a hydraulic linkage where there is a feed-back of power from one motor to another maintaining a balanced output at the bit in either a high speed stack, or a high torque stack as described hereinafter.

It may also be observed that in all of these uses the stacking of three motors results in a drill with the bottom joint turning to the right and thus accommodating a right-hand conventional bit thread or a drill pipe thread in the case of its use as a power swivel. Such a stack has three times the speed and three times the power of a single motor, with the same torque in the high speed stack, and, as an illustration, six times the torque of a single motor and at lower speed in the high torque stack hereinafter described and termed "alternate arrangement".

It may be mentioned that a number of motors as disclosed in U.S. Pat. No. 2,898,087 and No. 3,603,407 may be coupled together in tandem; however, in coupling motors of those patents together the connections between the motors must be made through connecting rods.

While the principle of tandem coupling of the motors disclosed in U.S. Pat. Nos. 2,898,087 and 3,603,407 may not be as commercially advantageous because of the necessary presence of connecting rods which cause the assembly to be unduly long, the coupling may now be made commercially practical by making the motors of shorter length and thus reducing the over-all length of the unit.

In the embodiments wherein motors are coupled as described in connection with FIGS. 7 to 10 inclusive, there is in all cases an increase in horsepower and in bit speed but no increase in torque. For certain types of drilling, this is advantageous.

However, it is also possible to couple two motors together in a different manner whereby to increase the torque without increasing the speed. In order to accomplish this end, all the motors which are coupled together must be of the same type, i.e. they must be motors of the FIG. 1 type or motors of the FIG. 2 type, and the Moineau members thereof must all have threads of the same hand. If two or more motors of the FIG. 1 type are coupled together the Moineau elements thereof must have left-hand threaded elements and if two or more motors of the FIG. 2 type are coupled together they must all have Moineau elements with right-hand threads. With a stack of motors according to FIG. 1, the inner members will be rotating and in a stack of motors according to FIG. 2 the outer members will be rotating.

Figure 11:
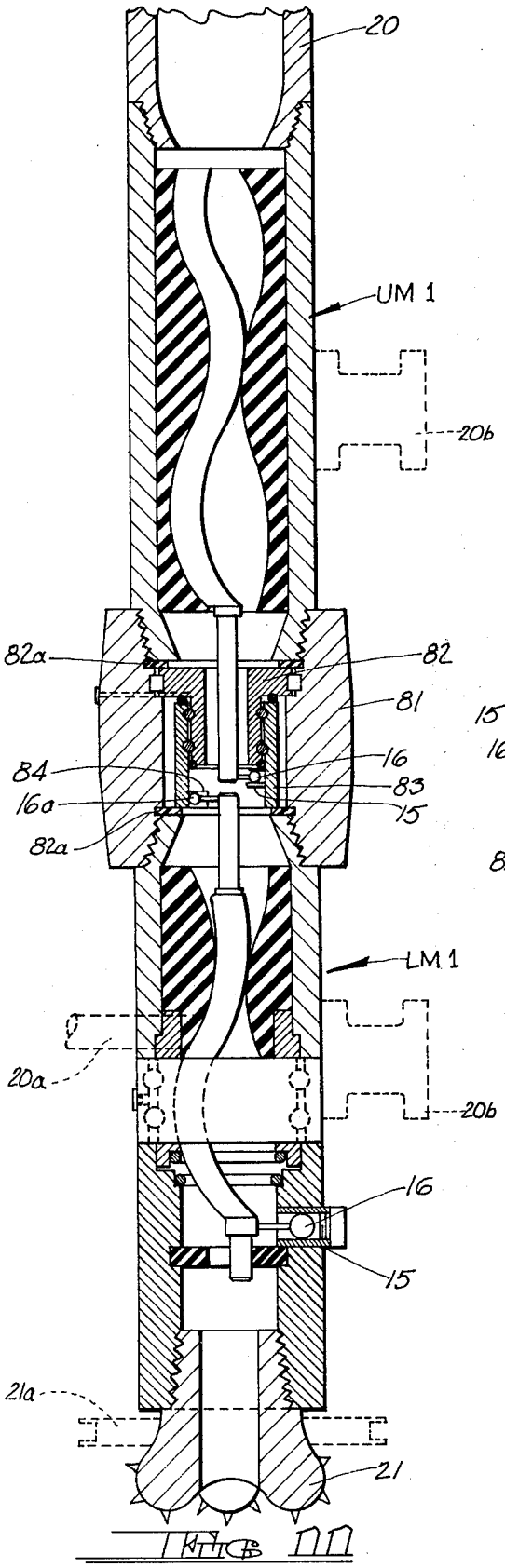
FIG. 11 is a somewhat diagrammatic view with parts in cross section showing two motors according to FIG. 1 coupled together in a different manner.

Thus, referring to FIG. 11 where there is shown an embodiment where two motors of the FIG. 1 type are coupled together, the outer members of the two motors are rigidly joined together by a coupling 81 of such diameter that the motors are threaded into it (the motors having pin ends and the coupling having box ends). The coupling is of such length that the motors are spaced apart to allow room for a water swivel to be disposed in the inner area of the coupling between the motors. The larger diameter of the water swivel indicated at 82 is securely keyed to the coupling so that the half 82 of the swivel conforms with any movement of lack of movement of the outer members of UM1. A snap ring 82a serves to hold the member 82 from axial movement. The smaller diameter of the water swivel indicated at 83 is thus left free to rotate and in this part of the swivel there is located a radial tube as described in connection with FIGS. 1 and 2 and indicated at 15. The ball 16 of the motor UM1 is engaged in the tube 15 so that as the inner member of UM1 rotates it carries with it the part 83 of the water swivel. The part 83 of the water swivel also carries a pair of cheeks 84 which perform the same function as the tube 15 but permits the ball 16a of the lower motor to move axially.

Thus, the motion of the inner member of UM1 is transmmitted through the tube 15 and ball 16 to the member 83 of the water swivel and in turn through the members 84 and ball 16a to the inner member of LM1. The motor LM1 is again provided with a ball 16 engaging in a tube 15 which therefore transmits the rotation of the inner member of the lower motor to the bit 21.

Figure 12:
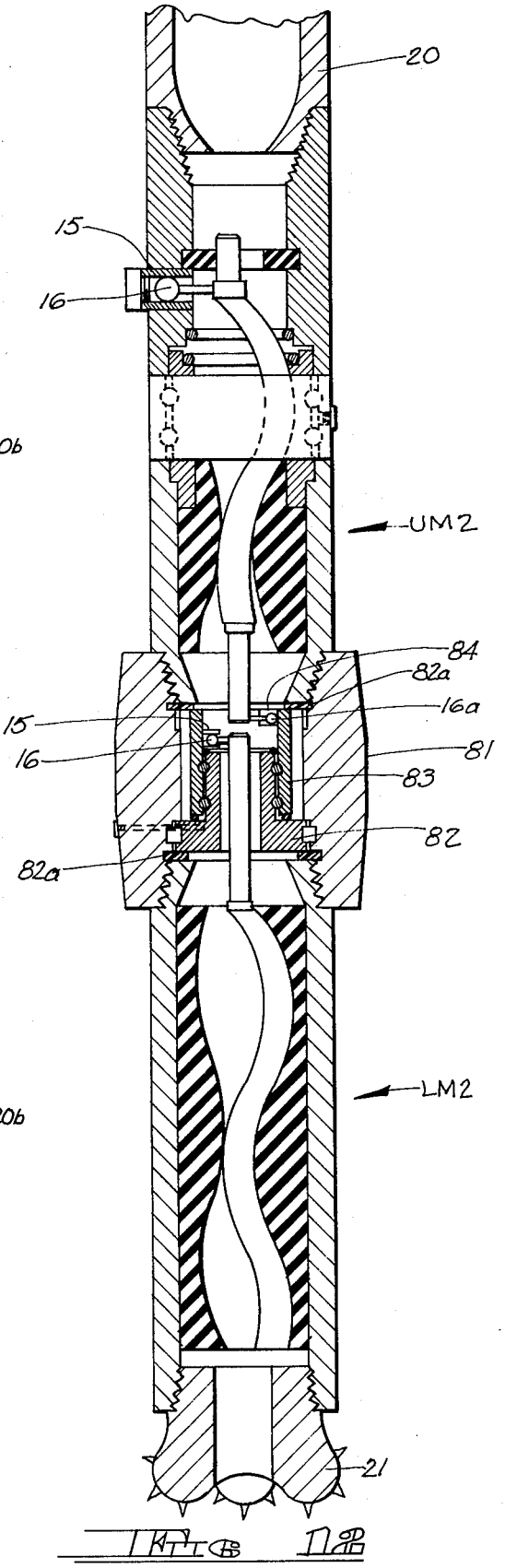
FIG. 12 shows two motors according to FIG. 2 coupled together in a different manner.

In the embodiment of FIG. 12, two motors of the FIG. 2 type are coupled together in substantially the same way, except in this embodiment the inner member of UM2 is held stationary by means of the ball 16 and tube 15 so that the outer member of UM2 rotates. In this embodiment the coupling 81 is disposed upside down with respect to its position in FIG. 11 and the rotation of the outer member of UM2 is transmitted to the outer member of LM2 while the inner members of UM2 and LM2 are rigidly held together by the balls 16 and 16a cooperating with the tube 15 and the cheeks 84 respectively.

It will be seen that this provides two more couplings for earth boring drills either with rotating outer housings or rotating inner members. The structure described at 84 permits the lower motor in FIG. 11 or the upper motor in FIG. 12 to be assembled and to permit the ball 16a to enter the rotation restraining members 84, and also to transmit torque while allowing aligned or deviated motors to operate in unison.

All threads will be of standard right hand and those of the bit will also be right-hand threaded.

Figure 13:
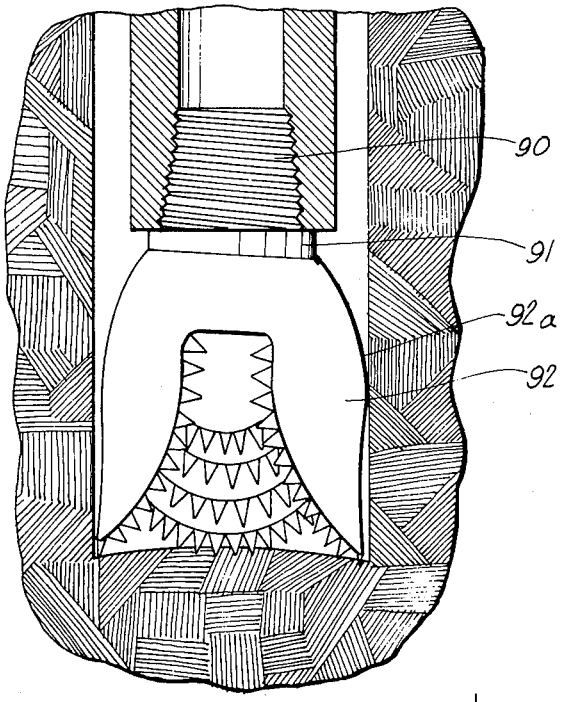
FIG. 13 shows a special tulip shaped bit attached at the bottom of the lowermost motor in a slightly canted position for use as in B and E of FIG. 15, or for conventional drilling, for purposes which will be described hereinafter.
Figure 13A:
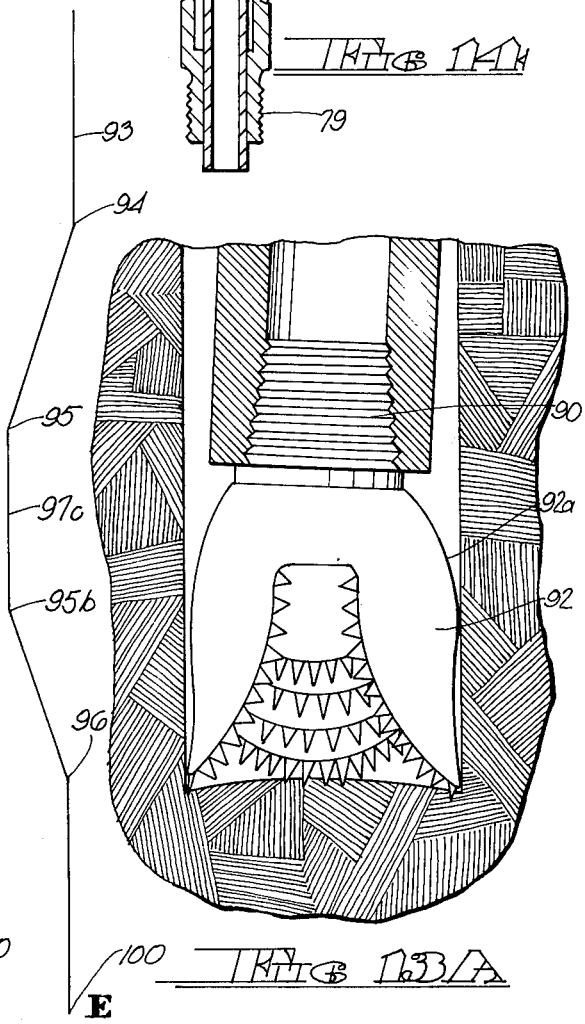
FIG. 13*a* is a view similar to FIG. 13 wherein the motor is canted for use as in FIG. 15 A, C or D, but with a axial bit.

In FIG. 13 there is shown the lower end of a motor combination just as those shown in FIGS. 7 to 12. However, in this case the threads at 90 and the shoulder on the bit at 91 are disposed at a slight angle to the axis of the drill so as to cant the bit 92 by perhaps two degrees more or less. The bit 92 is of a tulip configuration to provide the shoulder 92a for support against the bore hole wall. This arrangement makes it possible to use the inventive concept of the present invention in the manner described hereinafter in connection with FIGS. 15B and E, or in conventional drilling. In FIG. 13*a* the bit 92 may be the same as the bit of FIG. 13, but the threads 90 and shoulder 91 are axial, and this arrangement can be used in connection with FIGS. 15A, C and D where the lowermost motor is not axial with the hole, or where a single motor, not axial with the hole, is used.

An alternative arrangement to those of FIGS. 11 and 12 for increasing torque may be achieved with any of the combinations of FIGS. 7 to 10. If the hand of the lower motor in each case is reversed, and the pitch length of the lower motor is reduced, it is possible to reduce the speed of the bit while increasing the torque. Thus in FIG. 7, the Moineau elements of LM1 would be provided with a right-hand thread; in FIG. 8 LM2 would have a left-hand thread; in FIG. 9 LM2 would have a left-hand thread, and in FIG. 10 LM1 would have a right-hand thread. Additionally all the lower motors would have a shortened pitch length to make for an over-all shortened assembly and a higher rotative speed than the upper motors and the rotation of the lower motors will be in the opposite direction. By way of example, if it is desired that the lower motor at half the speed of the upper motor, the speed of the lower motor is increased to 150% of the speed of the upper motor. Thus, if the upper motor is designed to rotate at 350 rpm., the bit will turn at 525 rpm. in the opposite direction, or at a net speed of 175 rpm. The torque of the lower motor will be multiplied by 3 and obviously in such a stack, a left-hand threaded bit pin would be indicated. The upper motor in this alternate arrangement for increasing torque does not add to the horsepower of the lower motor or the assembly, but it serves as a spread controlling device for the lower motor members, and therefore for the bit ground speed, as well as acting as a shock absorber for the lower motor. As another example, if an upper motor runs at 300 rpm, and a lower motor at 360 rpm, the torque would be multiplied by 6. It will be clear that the torque increases as the bit slows down under load; this is the opposite from other downhole motors and Moineau type motors. Obviously, a lower motor running faster than double the speed of the upper motor would result in progressive torque reductions below the capability of the upper motor used singly. However the shock absorbing feature of the combination would still be retained.

In this alternative arrangement as to FIGS. 7 to 10, it will be advisable to lock the threads on the sub 80 in any well known manner, to prevent uncoupling in the event either motor lags. Similarly, the threads on the lower member of the lowermost water swivel in a stack in any of FIGS. 7 to 10, where the rotation is reversed, should be right-hand instead of the conventional left-hand.

The axial slot 84 for the ball 16a described in connection with FIG. 11 for example makes it possible to provide for a change in direction between adjacent motors and similarly an angle may be placed in the connection to the drill stem by the use of the so-called "bent sub". Such a sub is generally not actually bent but has a deviation in the threading of the shoulder at the base of the threads. It should be noted that the bend of the drill stem would allow for the use of the high speed concept of two or more motors according to FIGS. 7 to 10 inclusive and can be applied to only one motor of either the FIG. 1 or FIG. 2 basic concepts.

Figure 15:
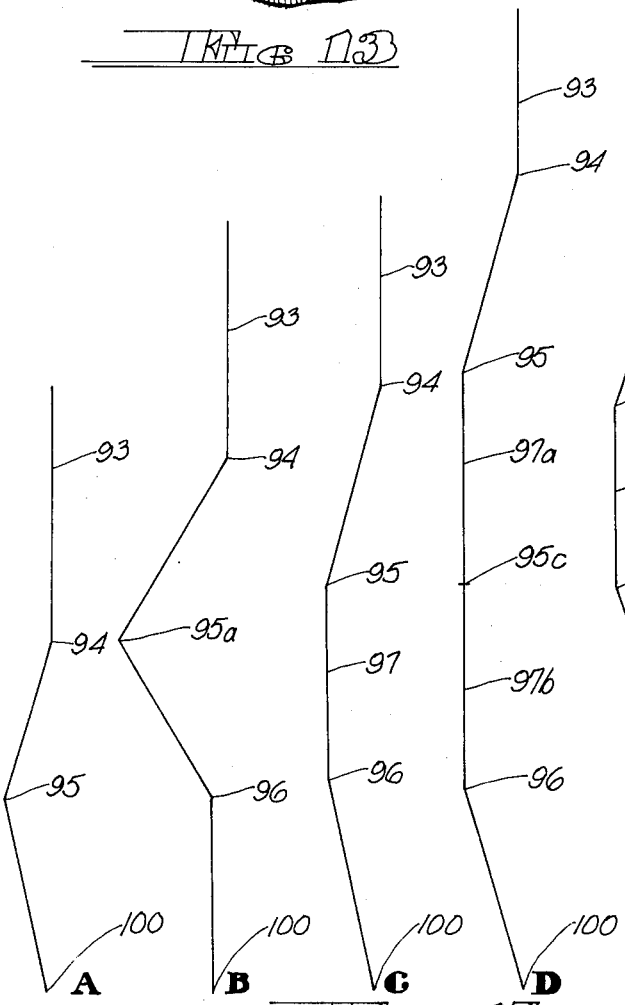
FIG. 15 is a diagram showing five different embodiments using motors with canted connectors for various special purposes.

FIG. 15 illustrates five different arrangements with various numbers of motors of the FIG. 12 concept angularly hooked together. It will be understood that FIGS. 15A to 15E are diagrammatic and that in such case the drill stem is indicated at 93. FIG. 15A shows an arrangement with two motors wherein the first angle is shown at 94 and then an angle in the opposite direction is shown at 95. In each case it will be understood that near the coupling or on the coupling there may be mounted a reamer of conventional type. The bit is shown at 100.

In FIG. 15B the first angle is provided at 94. The second angle 95a is twice the deviation of the angle at 94 and the angle at 96 is the same as at 94 but in a reverse direction so that the bit 100 is on the axial line.

FIG. 15C shows the use of three motors and FIGS. 15D and 15E show the use of four motors. In FIG. 15C reamers may be provided at 97 and the motors at 94, 95 and 96.

In FIG. 15D reamers may be provided at 97*a* and 97*b* and the motor connections again will be at 94, 95 and 95*c* and 96.

In FIG. 15E reamers may be provided at 97*c* and the motor connections at 94, 95, 95*b* and 96. It may be noted that in FIGS. 15C, D, and E, the second or third motor from the bottom is parallel to the axis of the bore and these motors could have one or more reamers mounted on them. All of these reamers could be rotatable in their mountings from time to time so as to distribute the wear throughout their periphery. Alternatively inside reamers could be omitted from the reamer body, unless roller reamers are used. In the arrangement of FIGS. 15A, C and D the bit FIG. 13A will continuously rock and cut on a slightly changing plane, as will bit FIG. 13 used at 100 in FIGS. 15B and 15E. This makes it possible for cuttings to be removed more readily and promotes a faster penetration rate. The resulting hole will be slightly oversize with respect to the bit diameter and this is beneficial in preventing a stuck bit. Actually a smaller hole than desired can be drilled and this can be opened in size, as the reamer will open and true up the hole with excess motor power being applied to it. The rock and roll movement of the bit maintains hole size and helps to overcome the problem of loss of gauge of the bit by wear. The bit legs will be convex on their outside to provide room to hollow out their tops to allow for flared gauge teeth to cut the bottom of the hole so that the wall of the hole will be vertical. The configuration is shown in FIG. 13.

It should of course be understood that the motor combinations of FIGS. 7 to 12 inclusive can be used as motors for other purposes than drilling. This may be used in any situation where it is desired to compound power and at the same time alter speeds and torque.

It should also be clear that since any Moineau motor can be used as a pump by driving one of the members and letting the helical gear pair provide pumping action (which is the reverse of motor action), there are advantages to the use of the devices of this invention as multistage pumps.

This is particularly advantageous in the embodiment of FIG. 11. Very slight modification only is needed. Thus instead of the bit 21 there is provided a pulley or gear indicated in broken lines at 21a for the purpose of driving the stack of pumps. Furthermore, a pump inlet would have to be provided as indicated in broken lines at 20*a* and the fitting 20 would then serve as the pump outlet. Mounting means would of course be provided to support the pump, as indicated in broken lines at 20*b*. In the embodiment of FIGS. 9 and 10, the driving gear or pulley 21*a* would have to be mounted centrally of the unit, as at 80, and mounting means similar to those shown in FIG. 11 at 20*b* would have to be provided for the stationary elements of the unit. In this way the device of FIG. 11 can serve as a multi-stage pump with two stages which double the output pressure. It will be clear that the pump inlet 20a passes through the stationary section of the water swivel. It is only necessary that a gear or pulley as at 21a be driven by a prime mover of some sort.

In this description, and in the appended claims, ther term "contrary rotation" means rotation in a direction opposite to direction necessary for the production of power. Further, the term "preventing contrary rotation" means restraining either the inner or outer gear member against relative rotation in a non-desired direction. This term does permit fractional cycles of oscillation in either direction during each revolution of the movable member.

It will be understood that the specific Figures are exemplary only and that modifications may be made without departing from the spirit of the invention. No limitation which is not expressly set forth is intended and no such limitation should be implied.

The embodiments of the invention in which an exclusive property or privileges is claimed are defined as follows:

1. First and second fluid motors coupled together in generally axial tandem relation, each of said motors comprising a helical gear pair including an inner member having one or more external helical threads, a cooperating outer member having one or more internal helical threads, the number of helical threads on said inner and outer members differing by one and a swivel having relatively rotatable sections;

a. the outer member of each of said gear pairs being fixed in a tubular casing secured to one of the sections of their associated swivel;

b. means associated with the end of the inner member of each of said gear pairs and with the other section of their associated swivel to prevent contrary rotation whle permitting gyration with oscillation of said inner member relative to said outer member;

c. the helical gear pair of said first motor having left-hand threads, and the tubular casing of said first motor being threaded onto the end of a string of drill pipe;

d. said first motor having its inner member connected to the inner member of said second motor, the helical gear pair of said second motor having right-hand threads; and e. a drill bit secured to the tubular casing of said lower motor.

2. The structure of claim 1 wherein the helical gear pair of said second motor has left-hand threads of shorter pitch than the first motor, whereby to increase the speed of said second motor.

3. The combination of claim 1 wherein at least one of the connections between a motor and a coupling or between a drill stem and a motor has a shoulder and threads disposed at an angle of a few degrees to the axis of the motor or coupling or drill stem, so as to provide for a rock and roll action of the bit.

4. The combination of claim 3 wherein the bit is of a tulip configuration to provide an upper bearing for the bit leg against the bore hole wall.

5. First and second fluid motors coupled together in generally axial tandem relation, each of said motors comprising a helical gear pair including an inner member having one or more external helical threads, a cooperating outer member having one or more internal helical threads, the number of helical threads on said inner and outer members differing by one, and a swivel having relatively rotatable sections;

a. the outer member of each of said gear pairs being fixed in a tubular casing secured to one of the sections of their associated swivel;

b. means associated with the end of the inner member of each of said gear pairs and with the other section of their associated swivel to prevent contrary rotation while permitting gyration with oscillation of said inner member relative to said outer member;

c. the helical gear pair of said first motor having right-hand threads, and the inner member of said first motor being connected to the end of string of drill pipe;

d. said first motor having its tubular casing connected to the tubular casing of said second motor, the helical gear pair of said second motor having left-hand threads; and e. a drill bit secured to the inner member of said second motor.

6. The structure of claim 5 wherein the helical gear pair of said second motor has right-hand threads of shorter pitch than the first motor, whereby to increase the speed of said second motor.

7. The combination of claim 5 wherein at least one of the connections between a motor and a coupling or between a drill stem and a motor has a shoulder and threads disposed at an angle of a few degrees to the axis of the motor or coupling or drill stem, so as to provide for a rock and roll action of the bit.

8. The combination of claim 11 wherein the bit is of a tulip configuration to provide an upper bearing for the bit leg against the bore hole wall.

9. First and second fluid motors coupled together in generally axial tandem relation, each of said motors comprising a helical gear pair including an inner member having one or more external helical threads, a cooperating outer member having one or more internal helical threads, the number of helical threads on said inner and outer members differing by one, and a swivel having relatively rotatable sections;

a. the outer member of each of said gear pairs being fixed in a tubular casing secured to one of the sections of their associated swivel;

b. means associated with the end of the inner member of each of said gear pairs and with the other section of their associated swivel to prevent contrary rotation while permitting gyration with oscillation of said inner member relative to said outer member;

c. the helical gear pair of said first motor having left-hand threads, and the tubular casing of said first motor being threaded onto the end of a string of drill pipe;

d. said first motor having its inner member connected to the outer member of said second motor, the helical gear pair of said second motor having left-hand threads; and e. a drill bit secured to the inner member of said second motor.

10. The structure of claim 9 wherein the helical gear pair of said second motor has right-hand threads of shorter pitch than the first motor, whereby to increase the speed of said second motor.

11. The combination of claim 15 wherein at least one of the connections between a motor and a coupling or between a drill stem and a motor has a shoulder and threads disposed at an angle of a few degrees to the axis of the motor or coupling or drill stem, so as to provide for a rock and roll action of the bit.

12. The combination of claim 18 wherein the bit is of a tulip configuration to provide an upper bearing for the bit leg against the bore hole wall.

13. First and second fluid motors coupled together in generally axial tandem relation, each of said motors comprising a helical gear pair including a inner member having one or more external helical threads, a cooperating outer member having one or more internal helical threads, the number of helical threads on said inner and outer members differing by one and a swivel having relatively rotatable sections;

a. the outer member of each of said gear pairs being fixed in a tubular casing secured to one of the sections of their associated swivel;
b. means associated with the end of the inner member of each of said gear pairs and with the other section of their associated swivel to prevent contrary rotation while permitting gyration with oscillation of said inner member relative to said outer member;
c. the helical gear pair of said first motor having right-hand threads, and the inner member of said first motor being connected to the end of a string of drill pipe;
d. said first motor having its tubular casing connected to the inner member of said second motor, the helical gear pair of said second motor having right-hand threads; and
e. a drill bit secured to the tubular casing of said second motor.

14. The structure of claim 13 wherein the helical gear pair of said second motor has left-hand threads of shorter pitch than the first motor, whereby to increase the speed of said second motor.

15. The combination of claim 13 wherein at least one of the connections between a motor and a coupling or between a drill stem and a motor has a shoulder and threads disposed at an angle of a few degrees to the axis of the motor or coupling or drill stem, so as to provide for a rock and roll action of the bit.

16. The combination of claim 15 wherein the bit is of a tulip configuration to provide an upper bearing for the bit leg against the bore hole wall.

17. First and second fluid motors coupled together in generally axial tandem relation, each of said motors comprising a helical gear pair including an inner member having one or more external helical threads, and a cooperating outer member having one or more internal helical threads the number of helical threads on said inner and outer member differing by one;

a. means for holding one of said inner and outer members of the first gear pair against rotation, while permitting relative rotation and gyration with oscillation between said members;
b. means connecting the rotating one of said members to one of the inner and outer members of the second gear pair;
c. the helical gear pair of said second motor having threads of opposite hand with respect to the hand of the threads of the helical gear pair of said first motor;
d. that one of the inner and outer members of the second motor which is connected to the rotating one of the inner and outer members of the first motor rotating in the same direction as the rotating one of the inner and outer members of the said first motor;
e. the other of the members of said second motor rotating in the opposite direction to the rotating one of the inner and outer members of said first motor;
f. said other member of said second motor having a drill bit secured thereto.

18. The structure of claim 17 wherein the helical gear pair of said lower motor has threads of shorter pitch than the upper motor, whereby to increase the speed of said second motor.

19. The combination of claim 17 wherein at least one of the connections between a motor and a coupling or between a drill stem and a motor has a shoulder and threads disposed at an angle of a few degrees to the axis of the motor or coupling or drill stem, so as to provide for a rock and roll action of the bit.

20. The combination of claim 19 wherein the bit is of a tulip configuration to provide an upper bearing for the bit leg against the bore hole wall.

21. First and second fluid motors coupled together in generally axial tandem relation, each of said motors comprising a helical gear pair including an inner member having one or more external helical threads, and a cooperating outer member having one or more internal helical threads the number of helical threads on said inner and outer members differing by one;

a. means for holding one of said inner and outer members of the first gear pair against rotation, while permitting relative rotation and gyration with oscillation between said members;
b. means connecting the rotating one of said members to one of the inner and outer members of the second gear pair;
c. the helical gear pair of said second motor having threads of same hand with respect to the hand of the threads of the helical gear pair of said first motor;
d. that one of the inner and outer members of the second motor which is connected to the rotating one of the inner and outer members of the first motor rotating in the same direction as the rotating one of the inner and outer members of the said first motor;
e. the other of the members of said second motor rotating in the opposite direction to the rotating one of the inner and outer members of said first motor;
f. said other member of said second motor having a drill bit secured thereto.

22. The structure of claim 21 wherein the helical gear pair of said lower motor has threads of shorter pitch than the upper motor, whereby to increase the speed of said second motor.

23. The combination of claim 21 wherein at least one of the connections between a motor and a coupling or between a drill stem and a motor has a shoulder and threads disposed at an angle of a few degrees to the axis of the motor or coupling or drill stem, so as to provide for a rock and roll action of the bit.

24. The combination of claim 23 wherein the bit is of a tulip configuration to provide an upper bearing for the bit leg against the bore hole wall.

25. In combination, first and second generally axially aligned fluid motors and a member coupling said fluid motors together; each of said motors comprising a helical gear pair including an inner member having one or more external helical threads, and a cooperating outer member having one or more internal helical threads the number of helical threads on said inner and outer members differing by one, the threads on the inner and outer members of said motors being of the same hand; said coupling member having a swivel therein with relatively movable members, one member of said swivel being keyed to said coupling member; the axially adjacent ends of the inner members of said motors cooperating with elements on one of the members of said swivel permitting independent gyration with oscillation, but preventing rotation one relative to the other, whereby holding the outer member of said first motor stationary while pumping fluid therethrough causes the inner members of said first and second motors to rotate, and holding the inner member of said first motor stationary while pumping fluid therethrough causes the outer members of said first and second motors and the coupling member to rotate; and a bit secured to the rotatable member of said second motor, the stationary member of said first motor being secured to a drill stem.

26. The combination of claim 25, wherein the outer member of the first motor is held stationary and the inner member rotates when fluid is pumped therethrough, the fixed member of said swivel is keyed to said coupling member, and both inner members are connected to the rotatable member of said swivel by said elements.

27. The combination of claim 25, wherein the inner member of the first motor is held stationary and the outer member rotates when fluid is pumped therethrough, the rotatable member of said water swivel is keyed to said coupling, and both inner members are connected to the fixed member of said swivel by said elements.

28. The combination of claim 25, wherein at least one of the connections between a motor and a coupling, or between a drill stem and a motor, has a shoulder and threads disposed at an angle of a few degrees to the axis of said motor or coupling or drill stem, so as to provide for a rock and roll action of the bit.

29. The combination of claim 28 wherein the bit is of a tulip configuration to provide an upper bearing for the bit leg against the bore hole wall.

30. In combination, first and second fluid motors and a member coupling said fluid motors together; each of said motors comprising a helical gear pair including an inner member having one or more external helical threads, and a cooperating outer member having one or more internal helical threads the number of helical threads on said inner and outer members differing by one, the threads on the inner and outer members of said motors being of the same hand; said coupling member having a swivel therein with relatively rotatable members, one member of said swivel being keyed to said coupling; the axially adjacent ends of the inner members of said motors cooperating with elements on one of the members of said swivel permitting independent gyration with oscillation, by preventing rotation one relative to the other; whereby holding the outer member of said first motor stationary while pumping fluid therethrough causes the inner members of said first and second motors to rotate, and holding the inner member of said first motor stationary while pumping fluid therethrough causes the outer members of said first and second motors and the coupling member to rotate.

31. The combination of claim 30, wherein the outer member of the first motor is held stationary and the inner member rotates when fluid is pumped therethrough, the fixed part of said swivel is keyed to said coupling member, and both inner members are connected to the rotatable part of said swivel.

32. The combination of claim 30, wherein the inner member of the first motor is held stationary and the outer member rotates when fluid is pumped therethrough, the rotatable part of said swivel is keyed to said coupling member, and both inner members are connected to the fixed part of said swivel.

33. The combination of claim 31, with means for driving one of the members of the gear pair of one of said motors whereby it acts as a pump.

34. The combination of claim 1, with means for driving one of the members of the gear pair of one of said motors whereby its acts as a pump.

35. The combination of claim 5, with means for driving one of the members of the gear pair of one of said motors whereby it acts as a pump.

36. In combination, first and second generally axially aligned Moineau fluid assemblies serving as a fluid pump or a fluid motor, each of said assemblies comprising inner and outer helical thread gear members, and means for drivingly coupling said assemblies together, the threads on the inner and outer members of said assemblies being of the same hand, said coupling means including a swivel having generally concentric relatively rotatable sections, first means for connecting the axially adjacent ends of said inner members to one of said swivel sections, and second means for connecting the axially adjacent ends of said outer members to the other of said swivel sections, said first connecting means including means for preventing either inner member from rotating relative to said one swivel section while permitting said inner members independently to gyrate and oscillate relative to said one swivel section.

37. An apparatus for drivingly coupling first and second generally axially aligned Monieau fluid pumps or motors, each having cooperating inner members with external helical threads and outer members with internal helical threads, said threads being of the same hand, said coupling apparatus comprising a swivel having relatively rotatable sections, first means for connecting said inner members to one of said swivel sections, and second means for connecting said outer members to said other swivel section, said first connecting means including means providing inwardly opening receivers on said one swivel section and means for engaging one of said receivers, said engaging means extending outwardly from each inner member, each engaging means and its receiver preventing rotation of its inner member relative to said one swivel section and permitting said inner member to gyrate and oscillate relative to said one swivel section.

* * * * *